US009797655B2

(12) United States Patent
McMahon et al.

(10) Patent No.: US 9,797,655 B2
(45) Date of Patent: Oct. 24, 2017

(54) METHOD AND APPARATUS FOR CONTROLLING COOLING TEMPERATURE AND PRESSURE IN WOOD VENEER JET DRYERS

(71) Applicant: USNR, LLC, Woodland, WA (US)

(72) Inventors: Irven McMahon, Painesville, OH (US); Bryan J. Wolowiecki, Painsville, OH (US)

(73) Assignee: USNR, LLC, Woodland, WA (US)

( * ) Notice: Subject to any disclaimer, the term of this patent is extended or adjusted under 35 U.S.C. 154(b) by 0 days.

(21) Appl. No.: 14/937,644

(22) Filed: Nov. 10, 2015

(65) Prior Publication Data

US 2016/0061521 A1 Mar. 3, 2016

Related U.S. Application Data

(60) Division of application No. 14/162,575, filed on Jan. 23, 2014, now Pat. No. 9,228,780, which is a continuation of application No. 13/469,372, filed on May 11, 2012, now Pat. No. 8,667,703, which is a continuation of application No. 12/068,529, filed on Feb. 7, 2008, now Pat. No. 8,196,310.

(Continued)

(51) Int. Cl.
*F26B 3/32* (2006.01)
*F26B 21/10* (2006.01)

(52) U.S. Cl.
CPC ..... *F26B 3/32* (2013.01); *F26B 21/10* (2013.01); *F26B 2210/14* (2013.01); *Y10T 156/1041* (2015.01)

(58) Field of Classification Search
CPC .... F26B 3/10; F26B 3/32; F26B 21/10; F26B 2210/14; Y01T 156/1041
USPC ..... 34/558
See application file for complete search history.

(56) References Cited

U.S. PATENT DOCUMENTS 2,344,686 A 3/1944 Fanselow
3,545,094 A * 12/1970 Barnes ..... F26B 15/00 34/396

(Continued)

FOREIGN PATENT DOCUMENTS

CA 2167462 C 7/1996
CA 2563456 A1 4/2008

(Continued)

OTHER PUBLICATIONS

U.S. Appl. No. 13/760,904 Office Action dated May 26, 2016, 10 pages.

(Continued)

*Primary Examiner* — Stephen M Gravini
(74) *Attorney, Agent, or Firm* — Schwabe Williamson & Wyatt, P.C.

(57) ABSTRACT

An apparatus for drying wood veneer includes an elongate drying chamber including a conveyor for conveying material to be dried from an input end to an output end; and a cooling section for cooling veneer leaving the output end of the drying chamber, the cooling section including a pressure controller for maintaining a pressure in the cooling section that is slightly higher than pressure in the drying chamber while maintaining a near-zero pressure differential between the drying chamber and the cooling section.

20 Claims, 5 Drawing Sheets

Related U.S. Application Data

(60) Provisional application No. 60/900,356, filed on Feb. 9, 2007.

(56) References Cited

U.S. PATENT DOCUMENTS

| | | | |
|---|---|---|---|
| 3,728,797 | A | 4/1973 | Worden et al. |
| 3,827,639 | A | 8/1974 | Relue et al. |
| 3,858,329 | A | 1/1975 | Koide |
| 3,940,230 | A | 2/1976 | Potter |
| 4,059,396 | A | 11/1977 | Dano |
| 4,139,953 | A | 2/1979 | Gaskell |
| 4,198,764 | A | 4/1980 | Ellison et al. |
| 4,215,489 | A | 8/1980 | McMahon, Jr. |
| 4,242,154 | A | 12/1980 | Pilling |
| 4,439,930 | A | 4/1984 | McMahon, Jr. |
| 4,549,362 | A | 10/1985 | Haried |
| 4,575,952 | A | 3/1986 | Bodenan et al. |
| 4,785,552 | A | 11/1988 | Best |
| 4,893,415 | A | 1/1990 | Moldrup |
| 4,923,484 | A | 5/1990 | Saito |
| 5,143,072 | A | 9/1992 | Kantorovich |
| 5,191,725 | A | 3/1993 | Wohlgenannt et al. |
| 5,228,209 | A | 7/1993 | Brunner |
| 5,307,679 | A | 5/1994 | Ross |
| 5,333,395 | A | 8/1994 | Bulcsu |
| 5,603,168 | A | 2/1997 | McMahon, Jr. |
| 5,605,274 | A | 2/1997 | Barten et al. |
| 5,820,642 | A | 10/1998 | Nagai et al. |
| 6,029,522 | A | 2/2000 | Schafer |
| 6,116,894 | A | 9/2000 | Kolln et al. |
| 6,195,909 | B1 | 3/2001 | Rogne et al. |
| 6,344,101 | B1 | 2/2002 | Graf |
| 6,481,118 | B1 | 11/2002 | De Vroome |
| 6,581,300 | B1 | 6/2003 | Grebe et al. |
| 6,959,668 | B2 | 11/2005 | Schreiner et al. |
| 7,926,200 | B2 | 4/2011 | Lenoir |
| 8,046,932 | B2 | 11/2011 | Wolowiecki |
| 8,196,310 | B2 | 6/2012 | McMahon et al. |
| 8,381,414 | B2 | 2/2013 | Wolowiecki |
| 8,667,703 | B2 | 3/2014 | McMahon et al. |
| 9,500,408 | B2 * | 11/2016 | Beagen, Jr. ..... F26B 15/122 |
| 2004/0079354 | A1 | 4/2004 | Takeda |
| 2008/0023547 | A1 | 1/2008 | Raichle et al. |
| 2008/0223547 | A1 | 9/2008 | Chahed |
| 2008/0307669 | A1 | 12/2008 | McMahon et al. |
| 2010/0230508 | A1 | 9/2010 | Petrovich |
| 2012/0036734 | A1 | 2/2012 | Wolowiecki |
| 2012/0216420 | A1 | 8/2012 | McMahon et al. |
| 2012/0246966 | A1 | 10/2012 | Straetmans et al. |
| 2013/0145646 | A1 | 6/2013 | Wolowiecki |
| 2014/0130368 | A1 | 5/2014 | McMahon |

FOREIGN PATENT DOCUMENTS

| | | | | |
|---|---|---|---|---|
| CA | 2577979 | A1 | 8/2008 | |
| CA | 2620499 | A1 | 8/2008 | |
| CA | 2864367 | A1 | 8/2008 | |
| CA | 2864368 | A1 | 8/2008 | |
| CA | 2607017 | A1 | 4/2009 | |
| CA | 2868013 | A1 | 4/2009 | |
| CA | 2868020 | A1 | 4/2009 | |
| CH | 624209 | A | 7/1981 | |
| DE | 102008006719 | A1 | 8/2009 | |
| EP | 0413517 | A2 | 2/1991 | |
| EP | 2180038 | A2 | 4/2010 | |
| FR | 2781710 | A1 | 2/2000 | |
| FR | 2861009 | A1 | 4/2005 | |
| GB | 340510 | A * | 12/1930 | ..... F26B 15/12 |
| GB | 1434339 | A | 5/1976 | |
| JP | 57153994 | A | 9/1982 | |
| JP | 58061867 | A | 4/1983 | |
| JP | 2000230781 | A | 8/2000 | |
| WO | 2013011167 | A1 | 1/2013 | |

OTHER PUBLICATIONS

Canadian Patent Application No. 2868013 Office Action dated Nov. 16, 2015, 4 pages.

Allen-Bradley Company Inc., "PLC-5 Processor-Based Dry Kiln Control System Helps Rosboro Lumber Win $209,000 Rebate From Local Utility," Application Solution, Rockwell Automation, 6723-1.3, http://literature.rockwellautomation.com/idc/groups/literature/documents/ap/6723-ap003_-en-p. pdf, Jul. 1996.

Examiner's Report from the Canadian Intellectual Property Office dated Sep. 20, 2013.

Canadian Examiner's Report for 2,868,013, dated Jul. 23, 2015.

Canadian Examiner's Report for 2,864,368 dated Oct. 23, 2014.

Canadian Examiner's Report for 2,864,367, dated Oct. 23, 2014.

Canadian Examiner's Report for 2,868,013, dated Dec. 22, 2014.

Canadian Examiner's Report for 2,864,368, dated Feb. 19, 2015.

U.S. Office Action for U.S. Appl. No. 13/760,904, dated Mar. 16, 2015.

Canadian Examiner's Report for 2,563456 dated Jun. 14, 2013.

Canadian Examiner's Report for 2,620,499, dated Feb. 21, 2013.

Canadian Examiner's Report for 2,620,499, dated Jun. 7, 2013.

Canadian Examiner's Report for 2,607,017 dated Nov. 20, 2013.

U.S. Office Action for U.S. Appl. No. 12/068,529 dated Aug. 11, 2011.

U.S. Office Action for U.S. Appl. No. 11/907,453 dated Dec. 19, 2008.

U.S. Office Action for U.S. Appl. No. 11/907,453 dated Aug. 18, 2010.

U.S. Office Action for U.S. Appl. No. 11/907,453 dated Feb. 23, 2009.

U.S. Office Action for U.S. Appl. No. 11/907,453 dated Feb. 18, 2010.

U.S. Office Action for U.S. Appl. No. 11/907,453 dated Oct. 16, 2009.

U.S. Office Action for U.S. Appl. No. 13/280,238 dated Jul. 18, 2012.

U.S. Office Action for U.S. Appl. No. 14/162,575 dated May 13, 2014.

U.S. Office Action for U.S. Appl. No. 14/162,575 dated Sep. 23, 2014.

U.S. Office Action for U.S. Appl. No. 14/162,575 dated Apr. 14, 2015.

U.S. Office Action for U.S. Appl. No. 13/760,904 dated Nov. 5, 2015.

Canadian Patent Application No. 2,868,013 Office Action dated Mar. 10, 2016, 3 pages.

Canadian Patent Application No. 2,868,013; Examination Report; dated Aug. 3, 2016.

U.S. Appl. No. 13/469,372; Notice of Allowance; dated Nov. 21, 2013.

U.S. Appl. No. 14/162,575; Notice of Allowance; dated Aug. 5, 2014.

Canadian Patent Application No. 2,868,013, Examiner's Report; dated Nov. 28, 2016.

U.S. Appl. No. 13/760,904; Final Office Action; dated Jan. 5, 2017.

* cited by examiner

METHOD AND APPARATUS FOR CONTROLLING COOLING TEMPERATURE AND PRESSURE IN WOOD VENEER JET DRYERS

CROSS REFERENCE TO RELATED APPLICATIONS

This application is a divisional of U.S. patent application Ser. No. 14/162,575 filed Jan. 23, 2014 entitled Method and Apparatus for Controlling Cooling Temperature and Pressure In Wood Veneer Jet Dryers, which is a continuation of U.S. patent application Ser. No. 13/469,372 filed May 11, 2012 entitled Method and Apparatus for Controlling Cooling Temperature and Pressure In Wood Veneer Jet Dryers, which is a continuation of U.S. patent application Ser. No. 12/068,529 filed Feb. 7, 2008 entitled Method and Apparatus for Controlling Cooling Temperature and Pressure In Wood Veneer Jet Dryers, which claims priority from U.S. Provisional Patent Application No. 60/900,356 filed Feb. 9, 2007 entitled Method and Apparatus for Controlling Cooling Temperature and Pressure in Wood Veneer Jet Dryers.

FIELD OF THE INVENTION

This invention relates to the field of producing wood veneer and in particular to methods and apparatuses for controlling the temperature and pressure in the cooling sections of wood veneer jet dryers.

BACKGROUND

Applicant is aware of U.S. Pat. No. 5,603,168 which issued to McMahon, Jr. on Feb. 18, 1997 for a Method and Apparatus for Controlling a Dryer wherein it is taught that the cooling section cools into the material exiting the drying chamber of the dryer by blowing ambient air around the material as it travels through the cooling section. A control is provided for maintaining the pressure within the cooling section at a level greater than the pressure in the drying chamber. By operating the cooling section at a slightly higher pressure, leakage of exhaust gases from the drying chamber into the cooling section is inhibited. An automatic control for maintaining the required pressure differential between the cooling section and the drying chamber pressure is described. Pressure sensors are disclosed for monitoring the pressure in the drying chamber and the pressure in the cooling section. A controller was suggested to be connected to the pressure sensors and operatively coupled to a damper for controlling the flow of cooling air thereby controlling the pressure within the cooling section. Alternately, the speed of a cooling air blower may be adjusted. Applicant is also aware of U.S. Pat. No. 4,439,930 which issued Apr. 3, 1984 to McMahon, Jr. Both U.S. Pat. Nos. 5,603,168 and 4,439,930 are incorporated herein by reference.

Conventionally, the last structural units (sections), typically one to four, sections of veneer jet dryers comprise the cooling zone. They are typically fitted with vane axial-type supply air fans and motors delivering outside air to nozzle systems for direct cooling of the veneer passing through the heating and cooling sections. It is typically desirable to utilize the cooling zone to drop the surface temperature of the veneer to a specified level. This has typically been accomplished by turning certain sections of the cooling zone "on or off" as necessary to achieve the desired temperature, or to utilize an alternating current (AC) variable speed drive on the fan motors to vary the speed of the fans and, thereby, vary the veneer temperature. Being that these cooling sections are typically connected directly, that is, in fluid communication with the heated sections of the dryer, with only a baffle wall separating the two, there has not been the ability to control the flow of cooling zone air into or out of the dryer. This has resulted in either "cool" air being pushed into the heated drying process or heated process air flowing into the cooling zone specifically when the damper described in U.S. Pat. No. 5,603,168 is not present or set too far open.

The present invention contemplates an improved automatic control for maintaining the required pressure differential between the cooling section and the drying chamber. Pressure sensors are disclosed for monitoring the pressure in the drying chamber and the pressure in the cooling section. A controller connected to the pressure sensors is operatively coupled to a damper for controlling the flow of cooling air out of the dryer thereby controlling the pressure within the cooling section above dryer pressure. Alternately, the speed of a cooling air blower may be adjusted.

SUMMARY

Among its various objects, the present invention provides for automatically balancing the pressure between an enclosed veneer dryer and its associated cooling section by adjusting the pressure in the first cooling section, both up and down, as needed to inhibit airflow between the adjacent sections.

Thus, in one aspect of the present invention, the first cooling section, which is attached directly to the last heated dryer section, is modified to create a "pressure seal" for minimizing both the flow of heated process air from the dryer into the cooling zone or the flow of cool air from the cooling zone into the enclosed heated dryer. In one embodiment the first cooling section is fitted, in its discharge vent, with a tube-axial extractor fan and motor controlled by a frequency drive, conjoined with a modulating, balanced-blade damper. The section is mechanically sealed from both the enclosed dryer and second cooling section by two sets of baffle-like "stop-offs" that are mounted between the dryer rolls at the beginning and end of the section, restricting the movement of air in and out of the first cooling section. The stop-offs extend laterally across the veneer flow path and work in conjunction with the veneer conveying rolls. They, therefore, only allow restricted leakage or entrance of air past the pressure seal section entrance and exit.

Pressure-sensing manifolds are mounted on either side of the stop-offs between the enclosed dryer and first cooling section and are piped to a pressure transducer, which continuously monitors the differential pressure between the heated dryer and first cooling section. The signal from the transducer is processed in the dryer programmable logic controller (PLC) using a PID loop, described below, with split range control and a "near zero" set point, which produces a signal that both modulates the damper through the first half of the control range and controls the speed of the tube-axial extractor fan through the second half of the control range. The effect of this control is to maintain a slightly higher pressure in the first cooling section with a "near zero" pressure differential between the enclosed dryer and first cooling section, that is the "pressure seal" section, under all operating conditions. The resulting controlled condition minimizes pitch buildup in the dryer and cooler, minimizes volatile organic carbon (VOC) in the cooler vent and improves the drying process thermal efficiency.

In an additional embodiment, the cooler section air supply fans are controlled either by one or individual frequency drives receiving a signal from a proportional-integral-derivative (PID) loop in the dryer PLC and having an operator-established veneer temperature "set point" and a "process variable" measured by an infrared scanner mounted at the dry veneer moisture detector. If reduced cooling is required the air supply fans slow to satisfy the temperature set point. This action lowers the pressure in the in the first cooling section and its discharge damper closes to again balance the pressure in this the cooler "seal" and the extractor fan stops. If increased cooling is required, the air supply fans increase in speed and the pressure seal discharge damper modulates to full open at the end of the first half of the control range and, as more cooling is required, in the second half of the control range the extractor fan begins to increase in speed to satisfy the near-zero pressure "set point" of the first cooling section.

The supply and exhaust air for the cooling sections are normally taken from and vented to atmosphere, for example above the factory roof, thereby allowing the cooling zone of the dryer to have a "net zero" impact on makeup air to the factory.

In summary, the wood veneer dryer according to embodiments of the present invention may be characterized in one aspect as including an elongate drying chamber having an input end and an output end and defining a path of movement between the ends. A conveyor conveys product to be dried along the path of movement through the drying chamber. The chamber includes a plurality of juxtaposed heating units sections, each heating unit defining a circulation path for heated air, the path being substantially transverse to the path of movement of the product to be dried. Nozzles forming part of each of the heating units direct heated air into an impinging relationship with the path of movement. An exhaust system extracts gases from an adjacent heating sections. A first pressure sensor senses a pressure in the output end of the drying chamber; a cooling section cools the veneer leaving the output end of the drying chamber. The cooling section includes pressure controlling means for maintaining a pressure in the cooling section that is higher, for example slightly higher than the pressure in the drying chamber while maintaining a near-zero pressure differential between the drying chamber and the cooling section. A second pressure sensor senses a pressure in the cooling section downstream of and adjacent to the output end of the dryer. A flow controller adjusts the rate of the exhaust flow as a function of the difference in pressure sensed by the first and second pressure sensors.

In one embodiment the flow controller includes a forced air input and a forced air extractor arranged laterally opposed across the path of movement in the first cooling section, and a damper cooperating with the air extractor.

Thus in some embodiments of the present invention, a method for controlling a wood veneer dryer may include:

a) providing a drying chamber having at least one drying section and corresponding upstream input and downstream output ends,
b) providing a cooling section at an output end of the drying chamber;
c) monitoring a first pressure of dryer gases at the output end;
d) comparing the first pressure with a second pressure in the cooling section;
e) adjusting a flow rate of cooling air in the cooling section so that the second pressure is greater than the first pressure and the pressure differential between the first and second pressures is near-zero.

In one embodiment the control is provided by the use of a PID loop using a split range controller wherein in a first, lower range, that is below the split, the position of the cooling section exhaust damper is controlled to control the pressure differential, and in the second, upper range, above the split, a forced air mover is also employed in a graduated fashion.

BRIEF DESCRIPTION OF THE DRAWINGS

With reference to the drawings in which similar characters of reference denote corresponding parts in each view.

DETAILED DESCRIPTION

Figure 1:
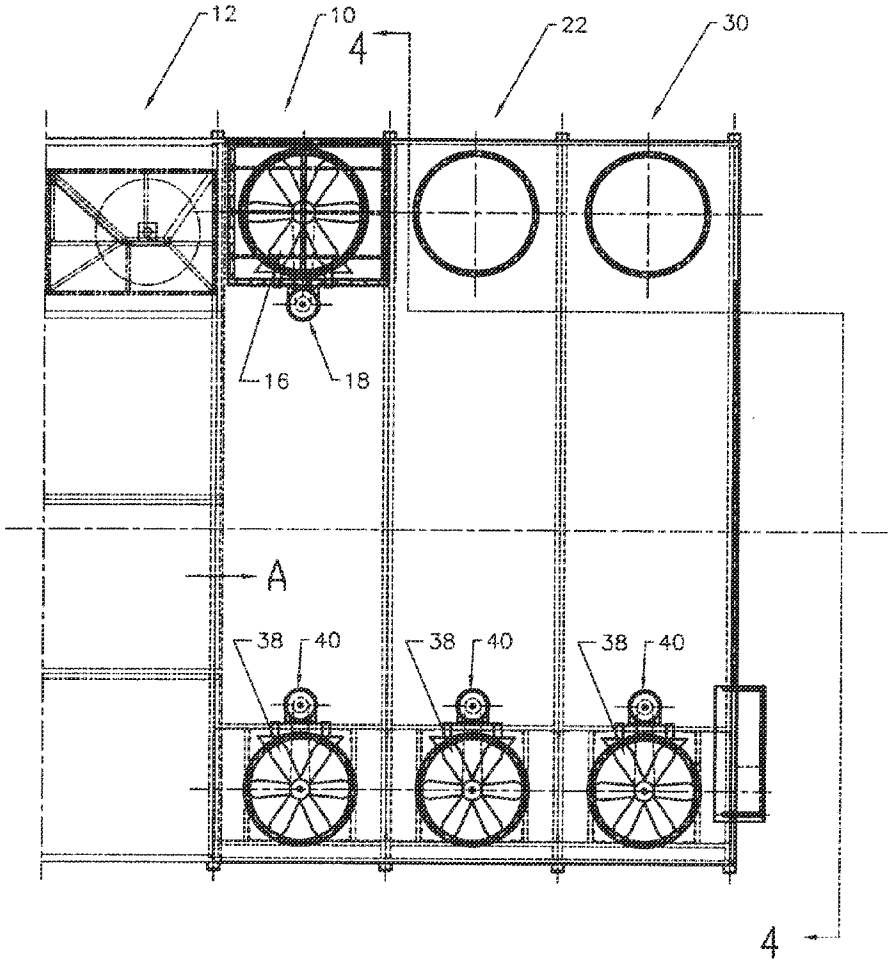
FIG. 1 is, in plan view, the wood veneer dryer cooling sections according to embodiments of the present invention.
Figure 2:
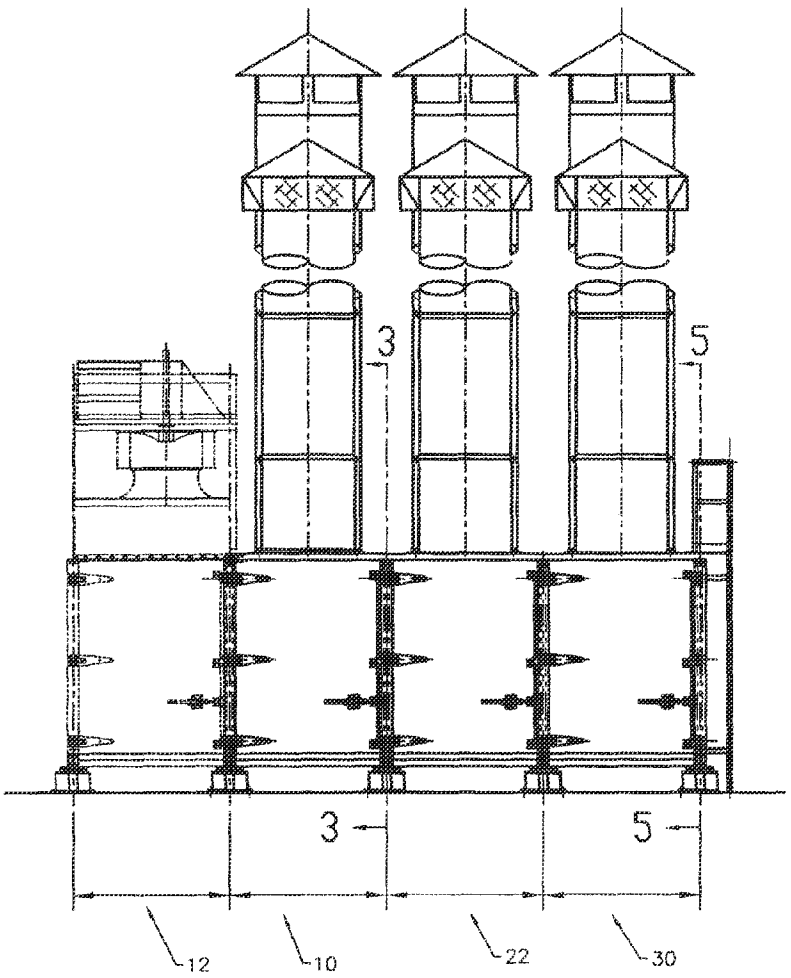
FIG. 2 is, in side elevation view, the cooling sections of FIG. 1.
Figure 3:
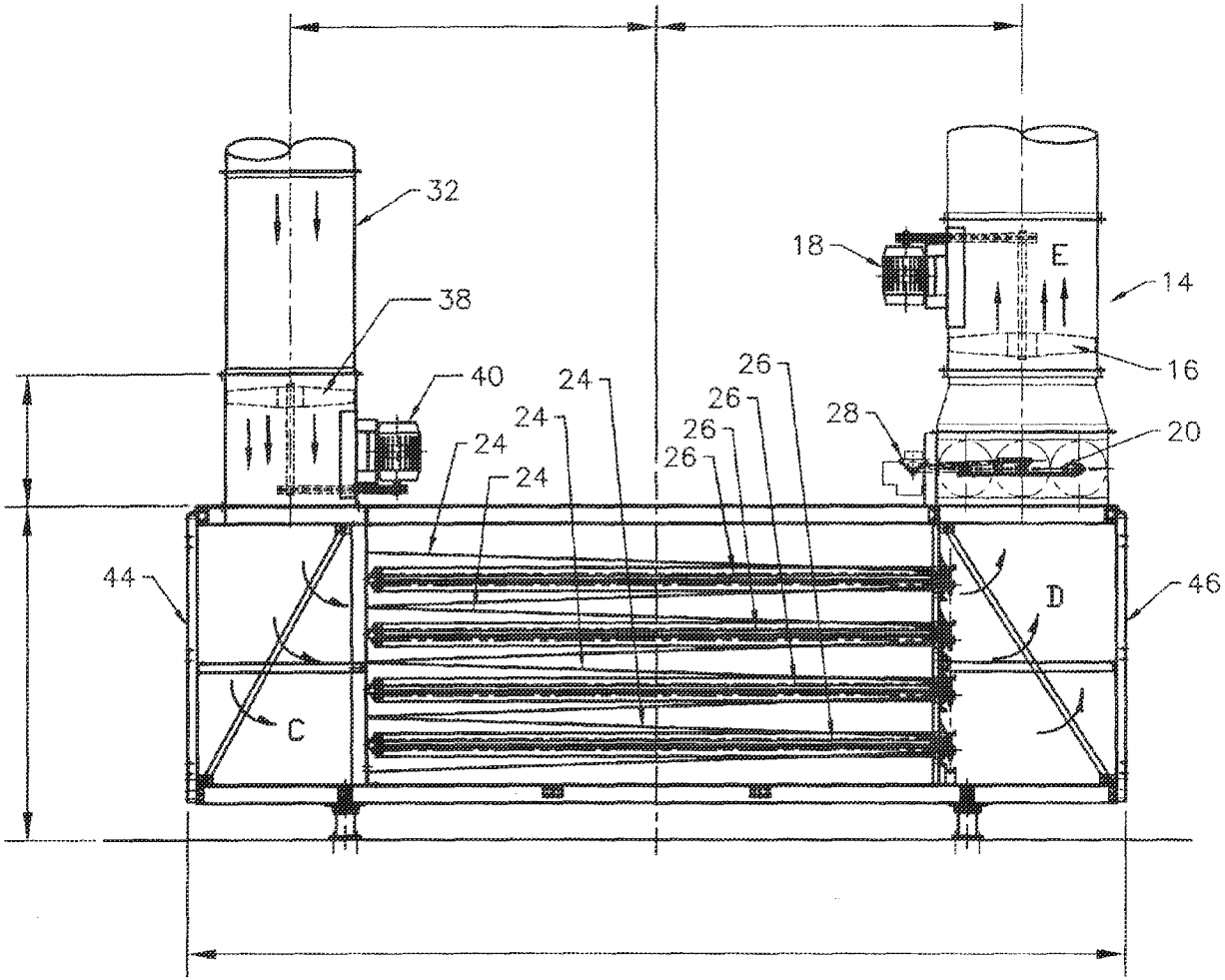
FIG. 3 is a sectional view along line 3-3 in FIG. 2.
Figure 4:
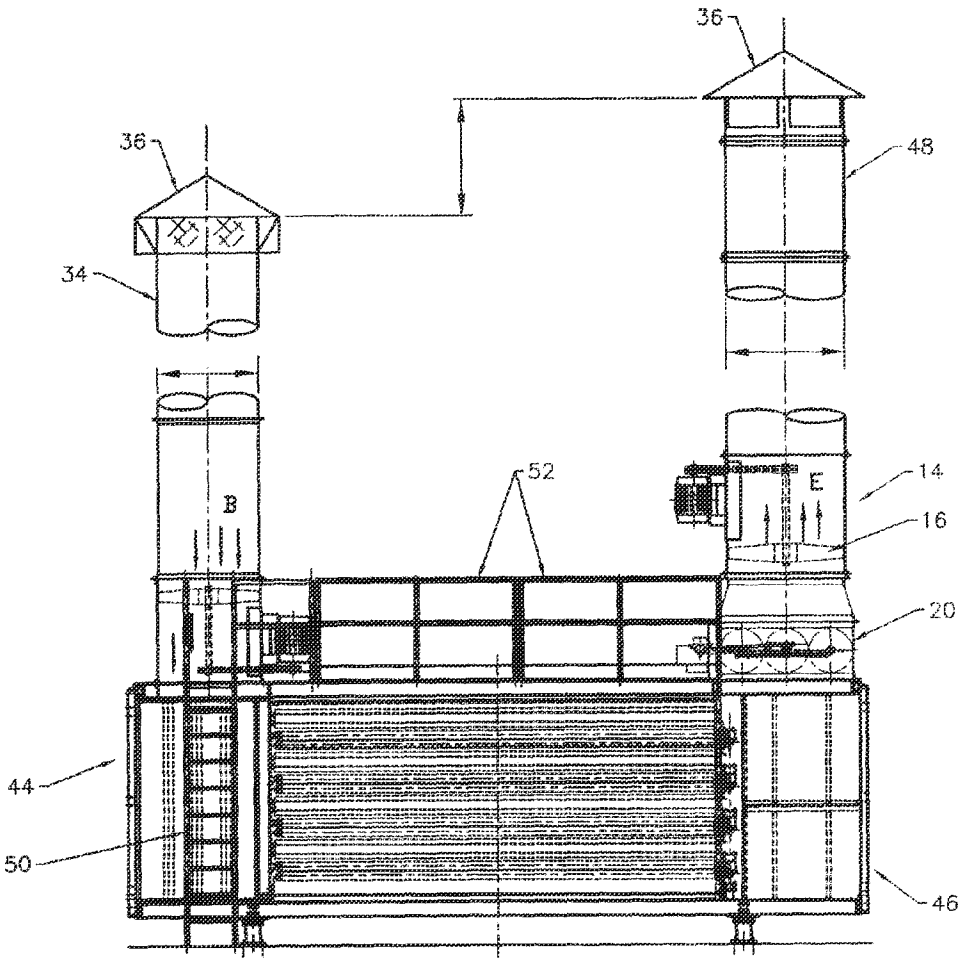
FIG. 4 is a sectional view along line 4-4 in FIG. 1.
Figure 5:
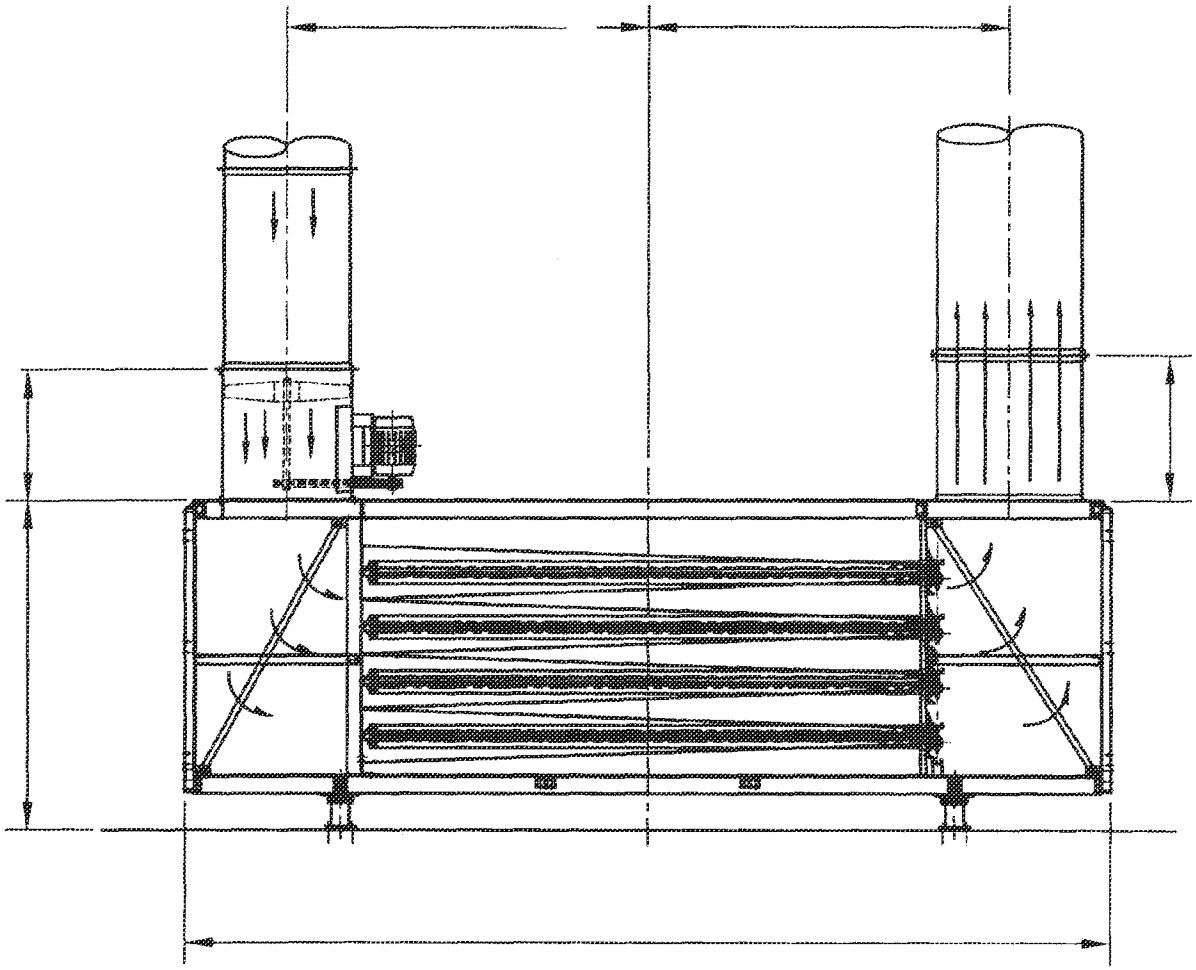
FIG. 5 is a sectional view along line 5-5 in FIG. 2.

First cooling section 10 is mounted directly to the last, that is most downstream, heated dryer section 12. Section 10 is modified to create a pressure seal for minimizing both the flow in direction A of heated process air from the dryer air into the cooling zone commencing in section 10 or the flow in the opposite direction of cool air from the cooling zone into the enclosed heated dryer. In one embodiment first cooling section 10 is fitted, in its discharge vent 14, with a tube-axial exhaust fan 16 and motor 18 controlled by a frequency drive, conjoined with a modulating, balanced-blade damper 20. Section 10 is mechanically sealed from both the last dryer section 12 and a downstream second cooling section 22 by two sets of stop-offs 24 that are mounted between the dryer rolls 26 in both the upstream and downstream ends of section 10, thereby restricting the movement of air into and out of first cooling section 10.

Pressure-sensing manifolds (not shown) are mounted on either side of stop-offs 24 between dryer section 12 and first cooling section 10 and are piped to a pressure transducer (not shown), which continuously monitors the differential pressure between the heated dryer and first cooling section. The signal from the transducer is used for predictive control and in particular is processed in a programmable logic controller (PLC) using a proportional-integral-derivative (PID) loop. As would be known to one skilled in the art, the PID loop automates what an intelligent operator with a gauge and a control knob would do. The operator would read a gauge showing the output measurement of a process, and use the knob to adjust the input of the process until the process's output measurement stabilizes at the desired value on the gauge. The position of the needle on the gauge is the "process variable" as used herein. The desired value on the gauge is referred to as the "setpoint" herein. The difference between the gauge's needle and the setpoint is the "error".

A control loop consists of three parts: measurement by a sensor connected to the process; decision in a controller element; and, action through an output device or actuator such as the extractor fan and damper herein. As the controller reads the sensor measurement, it subtracts this measurement from the setpoint to determine the error. It then uses the error to calculate a correction to the process's input variable so that this correction will remove the error from the process's output measurement. In a PID loop, correction is calculated from the error in three ways: cancel out the current error directly (Proportional), the amount of time the error has continued uncorrected (Integral), and anticipate the future error from the rate of change of the error over time (Derivative). The sum of the three calculations constitutes the output of the PID controller.

In an embodiment of the present invention the PID loop has a split pressure range control and a near-zero pressure differential set point. The PLC PID loop produces a signal that both modulates the actuation of damper 20 and its associated drive motor 28 through the first half of the control signal range and controls the speed of the tube-axial extractor fan 16 through the second half of the control signal range. The effect of this control is to maintain a near-zero pressure differential between the dryer section 12 and first cooling section 10, that is the pressure seal section, under all operating conditions. The control minimizes pitch buildup in the dryer and cooling sections 10, 22 and 30 minimizes volatile organic carbon (VOC) in the cooling section vents and improves the drying process thermal efficiency.

In an additional embodiment, the cooling section fans are controlled either by one or individual frequency drives receiving a signal from a PID loop in the dryer PLC and having an operator-established veneer temperature set point and a process variable measured by an infrared scanner (not shown) mounted at the dry veneer moisture detector (not shown). If reduced cooling is required the cooling section supply fans slow which lowers the pressure in the seal section and damper 20 adjusts toward closed to maintain the pressure balance in the seal section 10 and the extractor fan 16 stops. If increased cooling is required, the cooling section supply fans increase in speed, damper 20 modulates to full open and, as more cooling is required to maintain the veneer temperature setpoint and the extractor fan 16 begins to increase in speed to meet the cooling section pressure setpoint.

The first cooling section includes a provision for controlling the rate of exhausted cooling air such that a pressure is maintained in the cooling section that is greater than the pressure in the drying chamber. As a result, the flow of exhaust gas from the drying chamber to the cooling section is inhibited. Cooling air flowing from the inlet duct through the cooling section supply fan and enters an inlet chamber. As is conventional, the cooling air flows through jet nozzles and around the multiple levels of sheet material traveling through the cooling section and ultimately enters an exhaust chamber. From the exhaust chamber, the cooling air is exhausted through the outlet stacks. A damper assembly is positioned between the exhaust chamber and outlet stacks and controls the flow rate of the cooling air. Pressure sensors are positioned in the last drying section and also in the cooling section near the entrance to the cooling section. A differential pressure monitor or controller connected to the pressure sensors monitors for automatically controlling the position of the damper assembly so that a slightly positive pressure at the entrance to the cooling section, as compared to the drying sections, is maintained. As long as the pressure sensed by the sensor is greater than the pressure sensed by the drying section sensor, exhaust gases from the drying chamber will be inhibited from flowing into the cooling section. The position of the damper assembly is controlled by an electrically-operated rotary actuator.

The supply and exhaust air for the cooling sections is obtained and vented to atmosphere, for example above the factory roof, thereby allowing the cooling zone of the dryer to have a "net zero" impact on makeup air to the factory.

Cooling section 10 differs from cooling sections 22 and 30 in that cooling section 10, being the pressure seal section, includes exhaust fan 16 and damper 20 controlled by the PID loop. The intake side of cooling sections 10, 22 and 30 each, however, include ambient air intakes 32 so as to intake ambient air in direction B from intake stack 34. A hood 36 may be mounted atop each intake stack 34. Ambient air is drawn down through intake ducts 32 by supply fans 38 driven by drive motors 40.

Ambient air passes through fans 38 downwardly into supply chambers 44 so as to be turned in direction C. The ambient cooling air is thereby forced between the sheets of veneer passing downstream in direction A on rollers 26 thereby cooling the veneer. Once the cooling air has passed between and over the sheets of wood veneer on roller 26, the now warmed air is turned in direction D in exhaust chamber 46.

The warmed air then passes through damper 20 and continues upwardly in direction E through extractor fan 16 so as to be vented from discharge vent 14 through outlet stack 48.

In the illustrated embodiment, and in order put the scale of the diagrams into perspective, a ladder 50 and guard rail 52 are illustrated.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A dryer system comprising:

a drying chamber having a first pressure sensor and a plurality of nozzles, wherein the nozzles are arranged to direct heated air against materials moving through the drying chamber along a path of flow;

a second chamber coupled to one end of the drying chamber, the second chamber having an outlet passage and a second pressure sensor;

a first set of stop-offs disposed between the drying chamber and the second chamber, the first set of stop-offs configured to restrict airflow between the drying chamber and the second chamber;

a fan operatively coupled to the outlet passage, such that the fan is operable to draw air from the second chamber into the outlet passage;

a damper coupled to the outlet passage and selectively movable between an open position and a closed position to thereby adjust a rate of airflow from the second chamber into the outlet passage;

and a controller operatively coupled to the damper, the controller configured to control the damper, based at least on a difference between pressures detected by the first pressure sensor and the second pressure sensor, to maintain a desired pressure differential between the second chamber and the drying chamber.

2. The dryer system of claim 1, wherein the damper is disposed within the outlet passage upstream of the exhaust fan.

3. The dryer system of claim 1, wherein the second chamber is a first cooling section disposed at a downstream end of the drying chamber, the system further including a second cooling section with an input end, an output end, and a forced air intake, the input end of the second cooling section coupled to an output end of the first cooling section.

4. The dryer system of claim 3, further including a second set of stop-offs disposed between the first cooling section and the second cooling section.

5. The dryer system of claim 2, wherein the controller is a programmable logic controller configured to process pressures detected by the first and second pressure sensors according to a proportional-integral-derivative (PID) loop with a split pressure control signal range.

6. The dryer system of claim 5, wherein the split pressure control signal range has a first portion and a second portion, and the PID loop is configured to modulate operation of the damper in the first portion of the control signal range and to modulate operation of the fan in the second portion of the control signal range.

7. The dryer system of claim 1, wherein the controller is operatively coupled to the forced air intake and configured to adjust operation of the forced air intake based at least on a measured veneer temperature.

8. A wood veneer dryer, comprising:

an elongate drying chamber having an input end, an output end, a plurality of nozzles, and a conveyor, the conveyor defining a path of movement between said ends, wherein the nozzles are positioned to direct heated air against said path of movement within the drying chamber;

a first pressure sensor positioned to detect a pressure in said drying chamber;

a second chamber having an outlet passage, wherein the second chamber is coupled to one of the ends of the drying chamber and the path of movement extends through the second chamber, said second chamber having an outlet passage;

a second pressure sensor positioned to detect a pressure in said second chamber; and a flow controller operable to control a rate of air flow from the second chamber to the outlet passage, wherein the flow controller includes a fan positioned to draw air from the second chamber into the outlet passage and a damper coupled to the outlet passage upstream of the fan.

9. The wood veneer dryer of claim 8, wherein said second chamber further includes a forced air input, wherein the forced air input and said outlet passage are arranged laterally across said path of movement, and wherein the forced air input includes an inlet passage and a second fan positioned to move air into the second chamber through the inlet passage.

10. An apparatus for drying wood veneer, comprising:

an elongate drying chamber including a plurality of conveyor rolls for conveying material to be dried along a flow path and a plurality of nozzles positioned to direct heated air against the flow path;

a second chamber coupled to said drying chamber, said second chamber including an outlet passage;

a forced air extractor operatively coupled with the outlet passage, wherein the forced air extractor includes a fan and a damper; and pressure controlling means for controlling the forced air extractor to maintain a desired pressure differential between said drying chamber and said second chamber.

11. The apparatus of claim 10, wherein said means for controlling the forced air extractor includes a first pressure sensor positioned to detect a pressure within the drying chamber, a second pressure sensor positioned to detect a pressure within the cooling section, and a programmable logic controller operatively coupled with the pressure sensors and the damper, wherein the programmable logic controller is configured to control a position of the damper based at least on a difference between pressures detected by the pressure sensors.

12. The apparatus of claim 11, wherein the programmable logic controller is operatively coupled with the fan and further configured to control the fan based at least on said difference.

13. The apparatus of claim 11, wherein the second chamber is a cooling section disposed downstream of the drying chamber.

14. The apparatus of claim 13, wherein the programmable logic controller is further configured to control the fan based at least on said difference.

15. The wood veneer dryer of claim 11, wherein the damper is positioned within the outlet passage between the fan and the second chamber.

16. The wood veneer dryer of claim 8, further including a programmable logic controller operatively coupled with the pressure sensors and the damper, wherein the programmable logic controller is configured to control the damper based at least on a difference in pressures sensed by said first and second pressure sensors.

17. The wood veneer dryer of claim 15, wherein the damper is a modulating balanced-blade damper.

18. The wood veneer dryer of claim 16, wherein the programmable logic controller is further configured to control the fan based at least on said difference.

19. The wood veneer dryer of claim 16, wherein the second chamber further includes an inlet passage and a second fan positioned to direct air into the second chamber through the inlet passage.

20. The wood veneer dryer of claim 19, wherein the programmable logic controller is further configured to control the second fan based at least on a difference between a detected veneer temperature and a desired veneer temperature.

* * * * *